US005848887A

United States Patent [19]

Zabielski et al.

[11] Patent Number: 5,848,887

[45] Date of Patent: Dec. 15, 1998

[54] LOW EMISSION COMBUSTION SYSTEM

[75] Inventors: Martin F. Zabielski, Manchester; Brian A. Knight, Tolland; Richard P. Muth, Southington, all of Conn.

[73] Assignee: Carrier Corporation, Syracuse, N.Y.

[21] Appl. No.: 753,564

[22] Filed: Nov. 26, 1996

[51] Int. Cl.[6] ..... F24D 14/46

[52] U.S. Cl. ..... 431/353; 431/347; 431/326; 431/328; 431/170; 431/2; 431/7; 126/91 A

[58] Field of Search ..... 431/354, 352, 431/353, 351, 7, 170, 326, 328, 100, 347, 329, 2; 126/116 R, 92 C, 92 AC, 91 A

[56] References Cited

U.S. PATENT DOCUMENTS

| | | | |
|---|---|---|---|
| 4,776,320 | 10/1988 | Ripka et al. | 126/99 |
| 4,904,179 | 2/1990 | Drago et al. | 431/2 |
| 5,147,201 | 9/1992 | Xiong | 431/326 |
| 5,174,744 | 12/1992 | Singh | 431/347 |
| 5,244,381 | 9/1993 | Cahlik | 431/171 |
| 5,333,597 | 8/1994 | Kirkpatrick et al. | 126/110 |
| 5,370,529 | 12/1994 | Lu et al. | 431/353 |

FOREIGN PATENT DOCUMENTS 3413968A 10/1985 Germany .

*Primary Examiner*—Larry Jones
*Attorney, Agent, or Firm*—William W. Habelt

[57] ABSTRACT

A low emission combustion system for use in a fuel-fired apparatus includes a fuel-fired burner (30) operative for generating a flame extending substantially axially outwardly from the outlet of the burner, a heat transfer tube (40) opposed to the outlet of the burner whereby the flame extending from said burner passes into a flame inlet section (48) of the gas flow conduit (46) of the heat transfer tube, a radiator body (50) disposed within the flame inlet section of the gas flow conduit of the heat transfer tube, and a catalytic converter (60) for oxidizing carbon monoxide to carbon dioxide. The radiator body (50) has a thermal mass sufficient to reduce peak flame temperatures in the flame inlet section to less than 2800 F. The catalytic converter is disposed within the gas flow conduit at a location downstream of the radiator body.

4 Claims, 2 Drawing Sheets

LOW EMISSION COMBUSTION SYSTEM

TECHNICAL FIELD

The present invention relates generally to fossil fuel fired combustion systems and, more particularly, to a low emission combustion system for a gas-fired apparatus, such as residential heating furnaces, water heaters, and boilers, and method of operating same.

BACKGROUND ART

During the combustion of fossil fuels, including gaseous fossil fuels, in air, oxides of nitrogen ($NO_x$) are formed and emitted to the atmosphere in the combustion products. With respect to gaseous fuels, such as natural gas, liquefied natural gas, propane and other non-nitrogen containing fuels, the $NO_x$ is formed as a consequence of the high gas temperatures generated in the combustion process. It is known that reducing the peak temperatures within the combustion process to less than 2800 F. will substantially preclude $NO_x$ formation during the combustion of non-nitrogen bearing gaseous fuels. However, the reduction of peak temperatures to levels sufficient to substantially reduce $NO_x$ formation will typically result in incomplete combustion of the fuel, thus resulting in a reduced combustion efficiency and the undesired presence of carbon monoxide in the combustion products.

Oxides of nitrogen are an environmental concern as it is believed that $NO_x$ in the atmosphere plays a role in the formation of photochemical smog, the degradation of atmospheric visibility and the acidification of rain. Therefore, governmental agencies have passed legislation regulating the amount of oxides of nitrogen that may be admitted to the atmosphere during the operation of various combustion devices. For example, in certain areas of the United States, regulations limit the permissible emission of $NO_x$ from residential furnaces and water heaters to 40 ng/J (nanograms/Joule) of useful heat generated by these combustion devices. It is expected that future regulations will restrict $NO_x$ emissions from residential furnaces, water heaters and boilers to even lower levels.

One type of combustion system commonly used on fuel-fired residential furnaces includes a fuel burner of the "in-shot" type and a heat transfer tube having an open inlet, an open outlet, and an elongated tubular portion extending therebetween, typically in serpentine form. The fuel burner is arranged approximate the inlet of the heat transfer tube such that during operation a flame is injected into the heat transfer tube through the inlet thereof and the hot combustion products produced by the flame traverse the interior of the heat transfer tube to exit through the outlet thereof for venting to the atmosphere. A fan is arranged to cause a flow of air from the space to be heated over the exterior of the heat transfer tube whereby the air is heated by heat transferred through the wall of the heat transfer tube from the hot combustion products flowing therethrough.

U.S. Pat. No. 5,333,597, Kirkpatrick et al., discloses a gas-fired furnace utilizing such a combustion system and a method for inhibiting the formation of $NO_x$, wherein a porous abatement member is disposed in the flame inlet region of the heat transfer tube and has at least one section which is disposed transversely to the direction of gas flow whereby the combustion flame and combustion products pass through the body. The preferred abatement member is stated to be a metallic screen since metals are good thermal conductors and radiators, although ceramic refractory materials are also stated to be acceptable for use as abatement members.

U.S. Pat. No. 5,370,529, Lu et al, also discloses a gas-fired furnace utilizing such a combustion system wherein a mesh tube having a diameter which is substantially less than that of the combustor tube is disposed in the flame inlet region of the combustor tube. During operation of the burner, the flame injected into the combustor tube is forced through the mesh tube which operates to laterally reduce the cross-sections of the flame, increase the axial velocity of the flame, and substantially diminish the intimate contact of the secondary combustion with the maximum temperature zones of the flames within the combustor tubes, whereby $NO_x$ formation is said to be inhibited.

U.S. Pat. No. 5,244,381, Cahlik discloses a gas-fired furnace utilizing an inshot burner equipped combustion device wherein a flame spreader, which in the depicted embodiment comprises a stainless steel plate having a plurality of stainless steel rods mounted on its face, is disposed in the flame inlet region of the combustor tube. The flame spreader is said to absorb flame heat energy and lower the temperature of the flame, so as to reduce $NO_x$ formation in the flame.

A problem associated with the reduction of nitrogen oxide formation by lowering the flame temperature is that as the flame is quenched, combustion efficiency is reduced and combustion may not be totally completed. As a consequence of flame quenching, carbon monoxide formation will increase as nitrogen oxide formation decreases.

U.S. Pat. No. 5,174,744, Singh, discloses an industrial gas-fired burner wherein a block of highly porous reticulated ceramic foam is disposed in spaced relationship to and downstream of the burner nozzle. The burner is operated so as to produce a low temperature flame resulting in lower $NO_x$ emissions but also increased CO emissions. The incompletely combusted carbon monoxide passes through the ceramic foam block and is said to be oxidized into carbon dioxide by oxygen in the surrounding air as it traverses the hot foam block.

SUMMARY OF THE INVENTION

It is an object of the present invention to provide a low emission combustion system.

A low emission combustion system is provided for use in a fuel-fired apparatus including a fuel-fired burner operative for generating a flame extending substantially axially outwardly from the outlet of the burner, a heat transfer tube opposed to the outlet of the burner whereby the flame extending from said burner passes into a flame inlet section of the gas flow conduit of the heat transfer tube, a radiator body disposed within the flame inlet section of the gas flow conduit of the heat transfer tube, and a catalytic converter for oxidizing carbon monoxide to carbon dioxide. Preferably, the radiator body has a thermal mass sufficient to reduce peak flame temperatures in the flame inlet section to less than 2800 F. The catalytic converter is disposed within the gas flow conduit at a location downstream of the radiator body.

BRIEF DESCRIPTION OF THE DRAWINGS

The present invention will be described herein with reference to the drawing wherein.

DETAILED DESCRIPTION OF A PREFERRED EMBODIMENT

Figure 1:
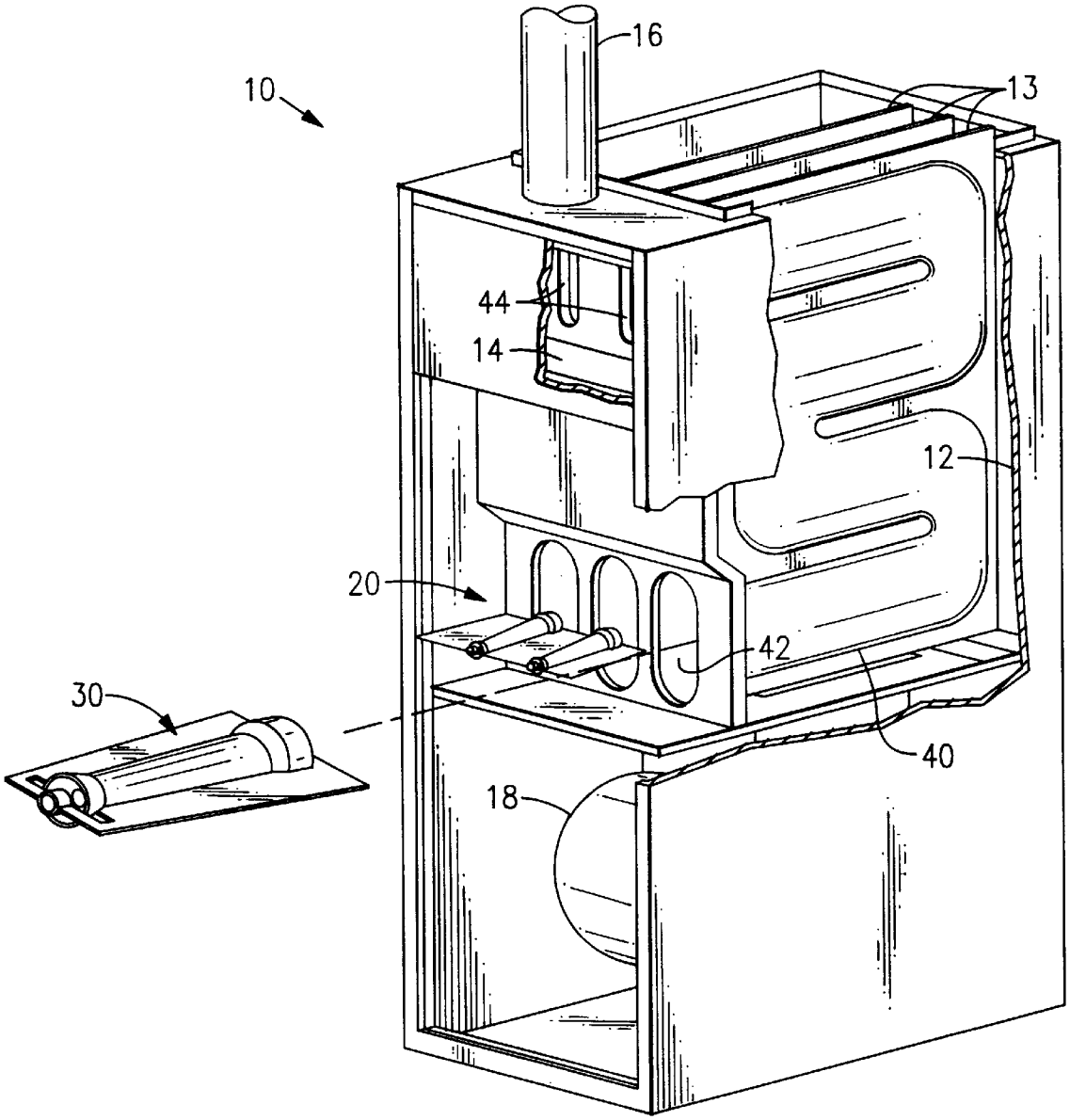
FIG. 1 is a partially exploded and partly broken away isometric view of a gas-fired furnace equipped with a combustion system in accordance with the present invention.
Figure 2:
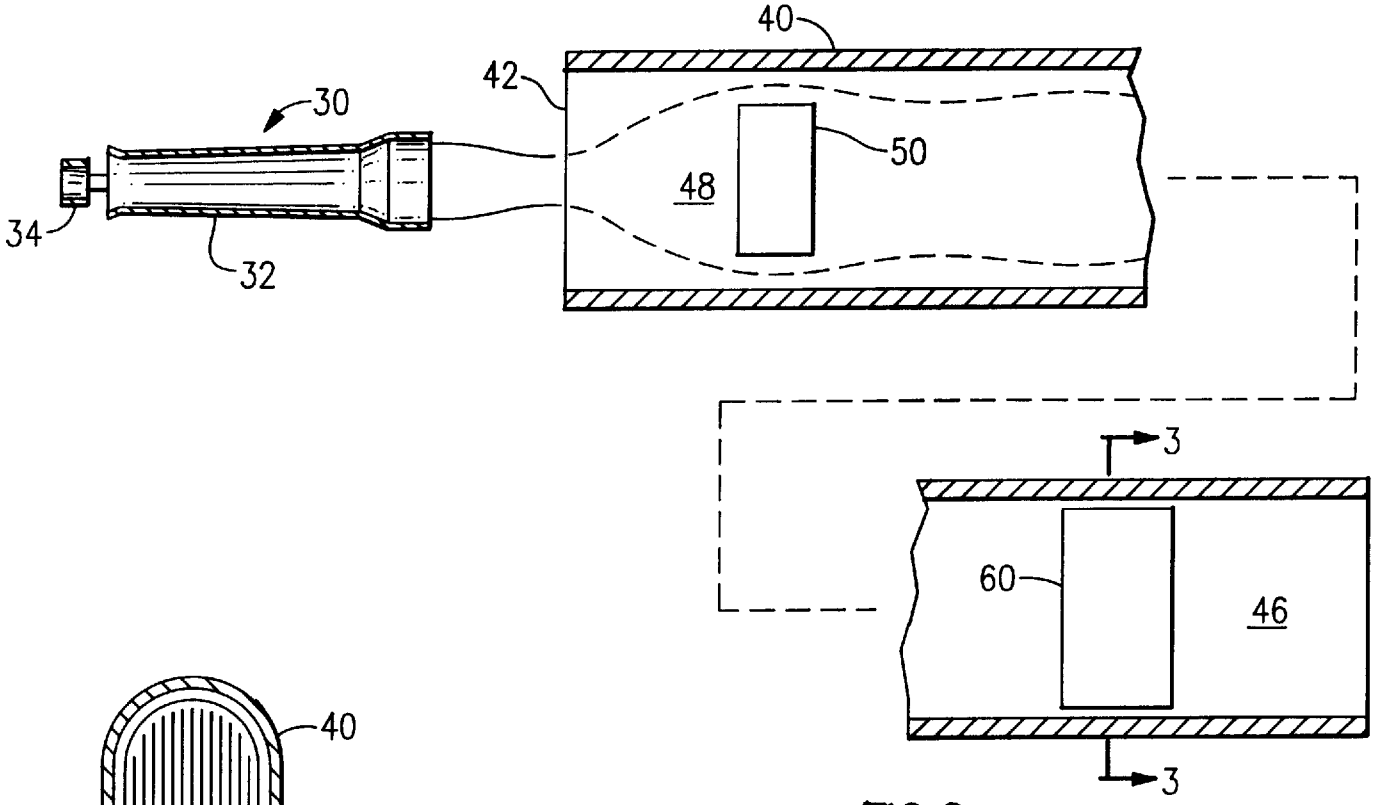
FIG. 2 is a sectional side elevation view of the combustion system of the present invention.
Figure 3:
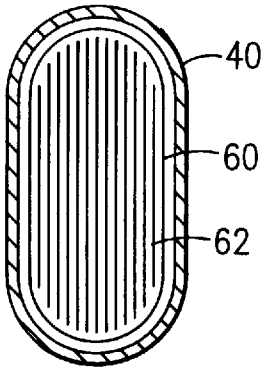
FIG. 3 is a cross-sectional view taken along line 3—3 of FIG. 2.

For purposes of illustration, the combustion system of the present invention is shown in the drawings as embodied in a gas-fired residential heating furnace equipped with an inshot burner. It is to be understood, however, that the principles of the present invention are applicable to other types of burners and fuel-fired appliances.

Referring now to FIG. 1, there is depicted therein a gas-fired residential heating furnace 10 having a combustion system 20 including a plurality of burners 30 and a corresponding plurality of heat transfer tubes 40. While shown as comprising multiple burners and heat transfer tubes, it is to be understood that the combustion system 20 could comprise only a single burner and a single heat transfer tube.

In the depicted embodiment, the burners 30 are conventional inshot burners. Each inshot burner comprises an elongated, diverging housing 32 adapted to be connected to a gas supply line (not shown) in a conventional manner via fuel port 34. Primary combustion air is drawn into the housing 32 wherein the air mixes with the gas supplied through fuel port 34. The fuel-air mixture ignites and produces an axially extending flame at the outlet end of each of the burner housing 32, which flames enter a respective heat transfer tube. Secondary combustion air for supporting the combustion process is drawn into the axially extending flame downstream of the outlet of the burner.

The burners 30 and heat transfer tubes 40 are aligned in juxtaposition within the furnace housing 12 in a conventional manner such that, in operation, the flames of the burners 30 will enter a respective heat transfer tube 40 through an inlet 42 to the tube 40 disposed in opposed relationship to the outlet of a respective burner. The hot combustion products generated in the flames pass through the gas flow conduits 46 of their respective heat transfer tubes 40 and a tube outlet 44 to a common outlet plenum 14 from which the combustion products vent to the atmosphere through flue pipe 16. Further, a fan 18 is provided in the furnace for drawing air to be heated through an air inlet (not shown) and through the open spaces 13 between the laterally spaced, parallel heat transfer tubes 40 so as to flow over the exterior of the heat transfer tubes. As the air passes over the heat transfer tubes, the air is heated by heat conducted through the walls of the heat transfer tubes from the hot combustion products. The heated air passes out of the furnace housing into the building air ducts for distribution to the space to be heated.

Each of the heat transfer tubes 40 depicted in the drawing are of the clamshell plate type formed by assembling two mating plates, typically metallic, having a respective half of a gas flow conduit 46 formed therein. When the two mating plates are assembled, a heat transfer tube 40 is formed providing the serpentine gas flow conduit 46. It is to be understood, however, that the particular configuration or cross-sectional shape of the gas flow conduit 46 and construction of the heat transfer tube 40 may vary from that depicted herein without departing from the principles of the present invention.

As noted previously, each heat transfer tube 40 is disposed with its inlet 42 in opposed facing relationship to the outlet of a respective burner 30, whereby the flame extending axially outwardly from the burner outlet passes through the tube inlet 42 into a flame inlet section 48 of the gas flow conduit 46 of the heat transfer tube. The flame inlet section 48 extends downstream from the inlet 42 and comprises that region of the gas flow conduit 46 in which flame is typically present during normal operation of the burners 30 at maximum fuel input.

In accordance with the present invention, a radiator body 50 is disposed within the flame inlet section 48 of the gas flow conduit 46 of the heat transfer tube 40 and a catalytic converter 60 for oxidizing carbon monoxide to carbon dioxide is disposed within the gas flow conduit at a location downstream of the radiator body 50. The radiator body 50 is comprised of a high temperature tolerant material and is operative to limit the peak temperature in the flame by radiative heat transfer loss to the walls of the heat transfer tube 40. Advantageously, the radiator body 50 is made of a metal or ceramic material that, in addition to its high temperature tolerance, has a high specific heat and is a good radiator, for example silicon carbide or high temperature metals such as stainless steel or FeCrAl alloy. Preferably, the mass and specific heat of the radiator body 50 are selected to provide a thermal mass sufficient to reduce peak flame temperatures in the flame to less than 2800° F., whereby $NO_x$ formation will be substantially reduced. More preferably, the mass and specific heat of the radiator body 50 are selected to provide a thermal mass sufficient to reduce $NO_x$ emissions in the hot combustion products to less than 20 ng/J.

As a result of the lower peak flame temperatures associated with the combustion system of the present invention, carbon monoxide levels in the hot combustion product gases in the flame inlet zone substantially increase. However, as the hot combustion product gases pass through the catalytic converter 60, much of the carbon monoxide in the gases is oxidized to carbon dioxide by oxygen in the combustion air in the presence of the catalyst in the catalytic converter 60. Thus, the combustion product gases vented to the atmosphere from the outlet plenum 14 not only contain a low level of nitrogen oxides, but also a low level of carbon monoxide.

The catalytic converter 60 comprises a catalyst 62 capable of oxidizing carbon monoxide to carbon dioxide, including conventional catalysts such as, for example, platinum or palladium, carried on a substrate material that is highly porous to gas flow, such as, for example, highly porous reticulated foam or metal foil. The catalytic converter 60 is positioned at a location downstream of the radiator body 50 whereat the temperature of the combustion product gases passing through the gas flow conduit will during normal operation at maximum fuel input fall within an acceptable range for the particular catalyst carried on the catalytic converter 60, for example a gas temperature ranging from 850 to 1300 F.

Various modifications and adaptations of the embodiments of the present invention hereinbefore described may be readily apparent to those skilled in the art that may be made without departure from the spirit and scope of the present invention, the scope of which is defined in the appended claims.

What is claimed is:

1. A combustion system for use in a fuel-fired apparatus comprising:

a fuel-fired burner having an outlet, said burner operative for generating a flame extending substantially axially outwardly from the outlet of said burner;

a heat transfer tube having an inlet, an outlet, and a gas flow conduit extending therebetween, said heat transfer tube opposed to the outlet of said burner whereby the flame extending from said burner passes into a flame inlet section of the gas flow conduit of said heat transfer tube;

a radiator body disposed within the flame inlet section of the gas flow conduit of said heat transfer tube, said radiator body having a thermal mass sufficient to reduce peak flame temperatures in the flame inlet section to less than 2800 F.; and a catalytic converter for oxidizing carbon monoxide to carbon dioxide, said catalytic converter disposed within the gas flow conduit at a location downstream of the radiator body whereat the gas flow passing over said catalytic converter has a gas temperature in the range from 850 F. to 1300 F.

2. A combustion system as recited in claim 1 wherein said catalytic converter has a catalyst selected from the group comprising platinum, palladium and mixtures thereof.

3. A method of controlling nitrogen oxide and carbon monoxide emissions from a combustion system of a fuel-fired apparatus, the combustion system including a fuel-fired burner operative for generating a flame extending substantially axially outwardly from the burner; and a heat transfer tube having an inlet, an outlet, and a gas flow conduit extending therebetween, the heat transfer tube disposed opposite the burner whereby the flame extending from the burner passes into a flame inlet section of the gas flow conduit of the heat transfer tube, said method comprising:

disposing a radiator within the inlet section of the gas flow conduit of said heat transfer tube, the radiator body having a thermal mass sufficient to reduce peak flame temperatures in the flame inlet section to less than about 2800 F.; and oxidizing carbon monoxide within the gas flow to carbon dioxide in the presence of a catalyst disposed within the gas flow conduit at a location downstream of the radiator body whereat the gas flow passing over said catalyst has a gas temperature in the range from 850 F. to 1300 F.

4. A method as recited in claim 3 wherein said catalyst is selected from the group comprising platinum, palladium, and mixtures thereof.

* * * * *